US008240883B2

(12) United States Patent
Barbieri

(10) Patent No.: US 8,240,883 B2
(45) Date of Patent: Aug. 14, 2012

(54) LIGHTING SYSTEM

(76) Inventor: Frank A. Barbieri, Boca Raton, FL (US)

( * ) Notice: Subject to any disclaimer, the term of this patent is extended or adjusted under 35 U.S.C. 154(b) by 401 days.

(21) Appl. No.: 12/123,604

(22) Filed: May 20, 2008

(65) Prior Publication Data

US 2008/0291662 A1 Nov. 27, 2008

Related U.S. Application Data

(60) Provisional application No. 60/969,943, filed on May 24, 2007.

(51) Int. Cl.
*F21V 21/00* (2006.01)

(52) U.S. Cl. ..... 362/249.19; 362/123; 362/249.18

(58) Field of Classification Search ..... 362/564, 362/567–568, 123, 249.18–249.19, 654
See application file for complete search history.

(56) References Cited

U.S. PATENT DOCUMENTS

| | | | | |
|---|---|---|---|---|
| 4,516,193 | A * | 5/1985 | Murphy | 362/123 |
| 5,057,976 | A * | 10/1991 | DuMong | 362/123 |
| 5,823,659 | A | 10/1998 | Klose | |
| 5,941,626 | A | 8/1999 | Yamuro | |
| 5,971,563 | A | 10/1999 | Maggio | |
| 2007/0195516 | A1 * | 8/2007 | Cheng | 362/123 |

FOREIGN PATENT DOCUMENTS

JP 11111012 A1 4/1999

OTHER PUBLICATIONS

International Search Report and written opinion dated Nov. 24, 2009.

* cited by examiner

*Primary Examiner* — William Carter
(74) *Attorney, Agent, or Firm* — Laurence A. Greenberg; Werner H. Stemer; Ralph E. Locher

(57) ABSTRACT

A lighting system includes a plurality of circular or disk-shaped lighting rings suitable for installation on a Christmas tree. The lighting rings include lights affixed to a webbing or net, and slits and trunk apertures to facilitate their placement around the Christmas tree trunk. For connection to an electrical power source, the lighting rings include electrical connectors including female electrical and male electrical connectors.

16 Claims, 7 Drawing Sheets

LIGHTING SYSTEM

CROSS-REFERENCE TO RELATED APPLICATION

This application claims the priority, under 35 U.S.C. §119 (e), of provisional application No. 60/939,943, filed May 24, 2007. The prior application is herewith incorporated by reference in its entirety.

BACKGROUND OF THE INVENTION

Field of the Invention

The invention relates to the fields of lighting systems and decorations. More particularly, the invention relates to a multi-component lighting system for use in adding decorative lights to an object such as a Christmas tree.

Decorating an evergreen coniferous tree or artificial replica thereof with lights and ornaments has become a popular tradition associated with celebration of the Christmas holiday. The longstanding conventional method for adding lights to Christmas trees is to wind a string of lights around the branches of the tree. Whether one starts at the bottom of the tree or the top, this process typically results in lights positioned mostly toward the outsides of the branches of the tree. It is problematic and difficult to position the lights inward form the extremities of the branches. Moreover, it is difficult to uniformly distribute the lights and maintain them in the desired position to present a pleasing array and display of lights on the tree. While simple, this conventional method often proves to be cumbersome and is also difficult to arrange the lights in an organized spaced array.

BRIEF SUMMARY OF THE INVENTION

The invention relates to the development of a new lighting system, particularly useful for a Christmas tree, that includes a series of differently sized vertically spaced lighting rings that may be positioned in roughly substantial horizontal orientation in spaced vertical layers on a Christmas tree. The rings are arranged in vertically spaced relation along the vertical axis of the tree. A plurality of spaced layers of rings are used to encompass substantially the entire circumference or perimeter of the tree to present a visually pleasing landscape of lighting for the entire tree. The largest lighting ring is positioned at the lowest (widest) part of the Christmas tree; the second largest lighting ring is placed a little above the largest ring; the third largest lighting ring is placed a little above the second largest ring; and so on until the tree is appropriately covered with lighting rings. Each layer of the lighting rings has a disk-shaped net or web of lights with an aperture at the center for fitting around or substantially encompassing the tree trunk and a slit running or extending from the aperture to the outside of the ring to allow the ring to be easily positioned around the trunk. The slit or opening defines a break in the periphery of the ring to facilitate locating the ring around the tree trunk. Each ring is made of conventional insulated flexible electric wire. Electrical connectors (male and female) are included on each ring, at spaced intervals and locations, for electrically connecting the rings to one another or an electrical power outlet. Standard sockets for holding bulbs are dispersed on each ring at substantially uniform locations connected to the electric wiring.

The lighting system of the invention is particularly well suited for use with artificial Christmas trees of the type where branches are inserted into a central pole from the bottom upwards. Each of the rings is laid on top of the branches of the tree at the appropriate location as the tree is being assembled.

Accordingly, the invention features a lighting system for illuminating a Christmas tree. The system includes a plurality of lighting rings having at least a first lighting ring having a largest single linear radially extending dimension, and also may include at least a second lighting ring having a largest single linear radial dimension that is smaller than the first lighting ring's largest single linear radial dimension, wherein each of the lighting rings making up the plurality includes an arrangement of lights affixed to an electrically conductive webbing, a female electrical connector and a male electrical connector, and wherein each of the lighting rings further includes a circumference, a trunk aperture positioned in the center of each ring, and a slit radially between the trunk aperture and the circumference. The radial slit extends between the center or trunk aperture and the periphery or circumference of the ring. The aperture substantially partially surrounds or encompasses the tree trunk, leaving an open slit on a side of the ring. A strap member such as a tie or velcro may be provided on the open side of the ring for connecting opposed sides of the slit to each other to support the ring securely in place on the tree. The strap can be adjustable to accommodate different sized rings and trees, and can be secured on one side of the slit to the electric wire and capable of overlapping and engaging the wire on the opposite side of the slit to hold the ring in place.

In another aspect, the invention features a method of decorating a Christmas tree with lights. This method includes the steps of: obtaining a lighting system including a first lighting and a second lighting ring as described in the foregoing paragraph and placing at least the first lighting and if desired the second lighting ring in vertically disposed locations on the Christmas tree.

Unless otherwise defined, all technical and legal terms used herein have the same meaning as commonly understood by one of ordinary skill in the art to which this invention belongs. Although apparatuses and methods similar or equivalent to those described herein can be used in the practice or testing of the present invention, suitable apparatuses and methods are described below. In addition, the particular embodiments discussed below are illustrative only and not intended to be limiting. Other features and advantages of the invention will be apparent from the following detailed description, and from the claims appended hereto.

Other features which are considered as characteristic for the invention are set forth in the appended claims.

Although the invention is illustrated and described herein as embodied in lighting system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
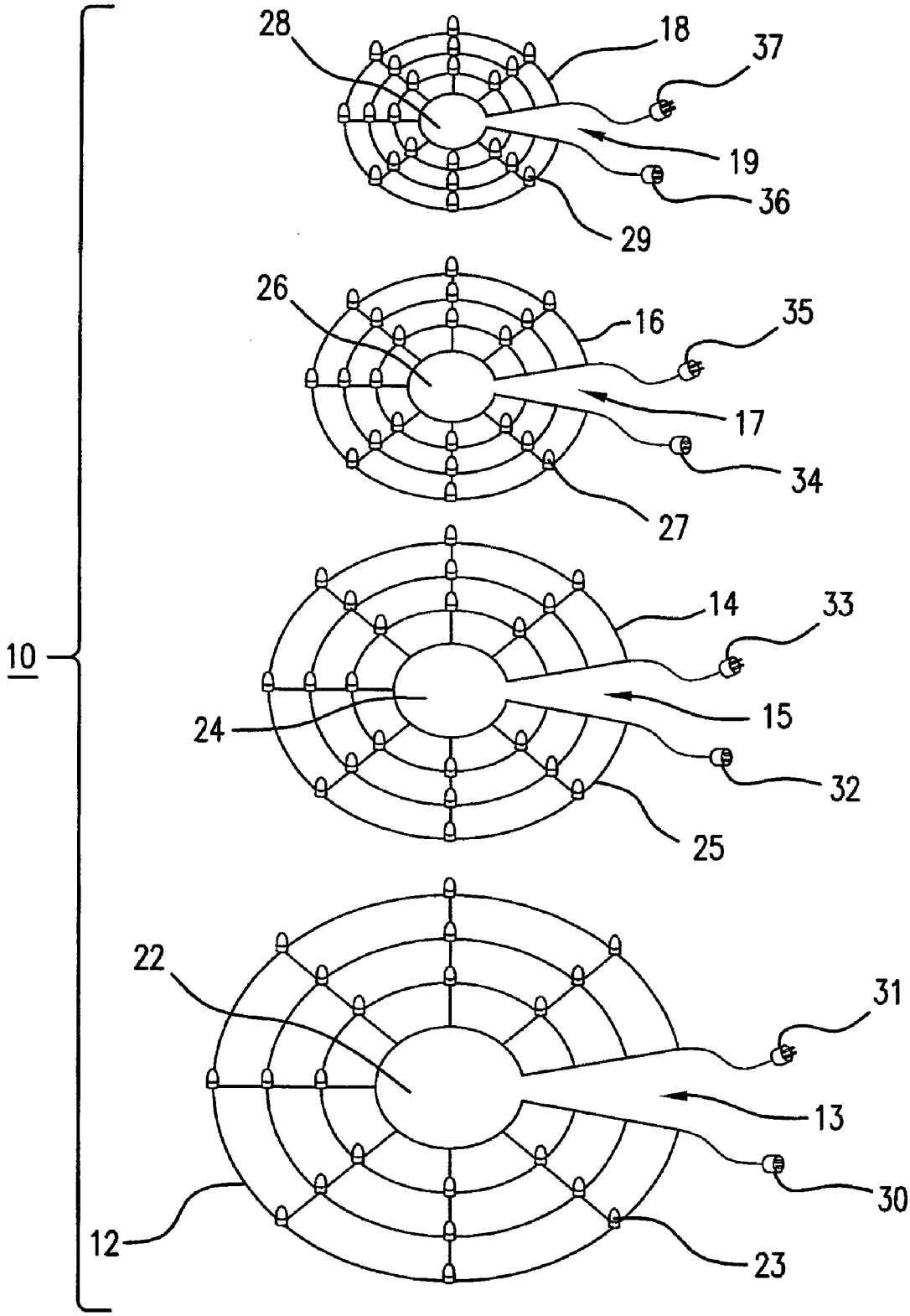
FIG. 1 is a top view of an embodiment of the tree lighting system of the invention having four light rings of different sizes.

Referring generally to FIG. 1, in an embodiment of the invention, a lighting system 10 includes a plurality of lighting rings 12, 14, 16, 18. The rings are arranged in substantially horizontal planar fashion vertically spaced along the tree axis, being substantially radially oriented at each vertical location. While in this embodiment, the system 10 includes four separate lighting rings 12, 14, 16, 18, in other embodiments, any suitable number of lighting rings could be used (e.g., 2, 3, 5, 6, 7, 8, 9, 10 or more). Even only one ring could be used if that was the preference. In the embodiment of FIG. 1, the lighting rings 12, 14, 16, 18 are shown as circular or disk-shaped. A circular shape is generally preferred to match the typical shape of a horizontal section of a Christmas tree. In other embodiments, the lighting rings could take any suitable shape such as star-shaped, oval, elliptical, square, rectangular, regular polygonal, or irregular polygonal. Each ring is made of electric wire and has a substantially planar horizontal shape radially extending from the center thereof to form a web or net like construction. The wires are interconnected electrically and structurally to form a web or net having open spaces at substantially regular intervals. To facilitate installation on a Christmas tree, the lighting rings 12, 14, 16, 18 include radially extending slits 13, 15, 17, 19 and central trunk apertures 22, 24, 26, 28. The apertures extend between the centers of the rings and their circumference or periphery. Lights affixed to a webbing or net 23, 25, 27, 29 form the body of each of the lighting rings 12, 14, 16, 18. For connection to an electrical power source, the lighting rings 12, 14, 16, 18 further include electrical connectors including female electrical connectors 30, 32, 34, 36 and male electrical connectors 31, 33, 35, 37. The web or net is flexible to radially conform to the shape of the tree at each vertical location along the tree axis.

Figure 2:
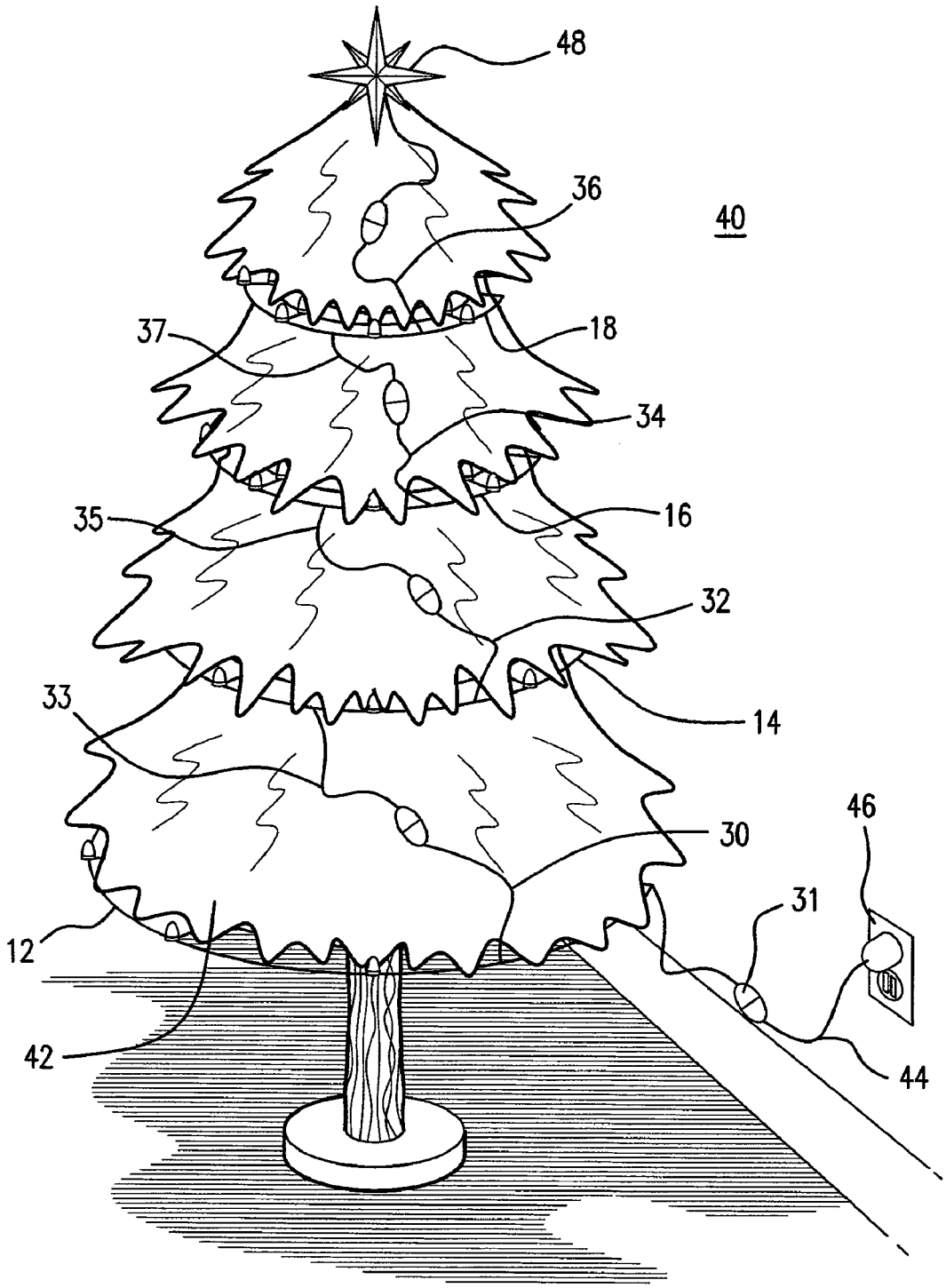
FIG. 2 is side view of a Christmas tree having installed thereon the lighting system of FIG. 1.

Referring to FIG. 2, to electrically connect the system 10 and its lighting rings 12, 14, 16, 18, some of the female electrical connectors 30, 32, 34 can be connected to some of the male electrical connectors 33, 35, 37. One of the male connectors 31 can be connected to an extension cord 44 connected to an electrical outlet 46, and one of the female connectors 36 can be attached to a star 48 or other tree-top decoration or ornament having an electrical input connector. Alternatively, one of the male connectors 31 can be connected to the electrical outlet 46 directly. Because almost all Christmas trees are roughly conical in shape and it is esthetically desirable to disperse lights uniformly vertically and horizontally throughout a Christmas tree, the lighting rings 12, 14, 16, 18 are of different sizes (e.g., diameters or radial lengths). Thus, when laid out on the tree, the rings are disposed horizontally and extend outward radially at spaced vertical locations along the tree axis, substantially conforming to the tree configuration at each location because of its flexibility. For example, the lighting system 10 shown in FIG. 1 includes four lighting rings 12, 14, 16, 18 including a largest lighting ring 12, a second largest lighting ring 14, a third largest lighting ring 16, and a fourth largest (or smallest) lighting ring 18. As an example, the diameters of the lighting rings 12, 14, 16, 18 can respectively be 2 m, 1.5 m, 1 m, and 0.5 m. In other examples, the diameter or largest single linear radial dimension of a lighting ring can range from about 10 m to 0.2 m (e.g., 11, 10, 9, 8, 7, 6, 5, 4, 3, 2, 1, 0.8, 0.6, 0.4, 0.2, or 0.15 m).

Referring again to FIG. 2, the lighting system 10 is shown installed on a live Christmas tree 40. In this embodiment, a person installing the system 10 on the tree 40 would take one of the lighting rings 12, 14, 16, 18 and fit it around the branches of the tree at a level where the horizontal circumference of the tree approximates the diameter or radial orientation of that particular lighting ring. For example, as shown, the largest lighting ring 12 is placed at a lower position on the tree, the second largest lighting ring 14 is placed just above the largest lighting ring 12, the third largest lighting ring 16 is placed just above the second largest lighting ring 14, and a fourth largest (or smallest) lighting ring 18 is placed near the top of the tree 40, Generally, the placement of each of the lighting rings 12, 14, 16, 18 will be roughly substantially horizontal with respect to the floor or surface that the tree is positioned on (or relative to the vertical axis of the tree). The sockets for the bulbs can be oriented to face upward or hang downward relative to each web or net. In installing each of the lighting rings 12, 14, 16, 18 on the tree 40, the installer would move each ring 12, 14, 16, 18 in a forward manner so that each of the slits 13, 15, 17, 19 pass by the trunk of the tree 40 and so that the trunk apertures are positioned around or substantially surround or encompass the trunk of the tree 40. In an embodiment of the present invention, there can be provided a connector member such as a strap (e.g., a plastic tie or Velcro strip) to secure opposing side of the radial slit securely in place around the tree trunk. The connector is shown as member 59 in FIG. 3*a* and can be secured at one side of the slit and loop over the opposing side to adjustable draw the sides closer together depending on tree trunk size. The connector helps to releasably secure the ring in place and may be located anywhere along the radial where best situated to perform the locking function.

Figure 3A:
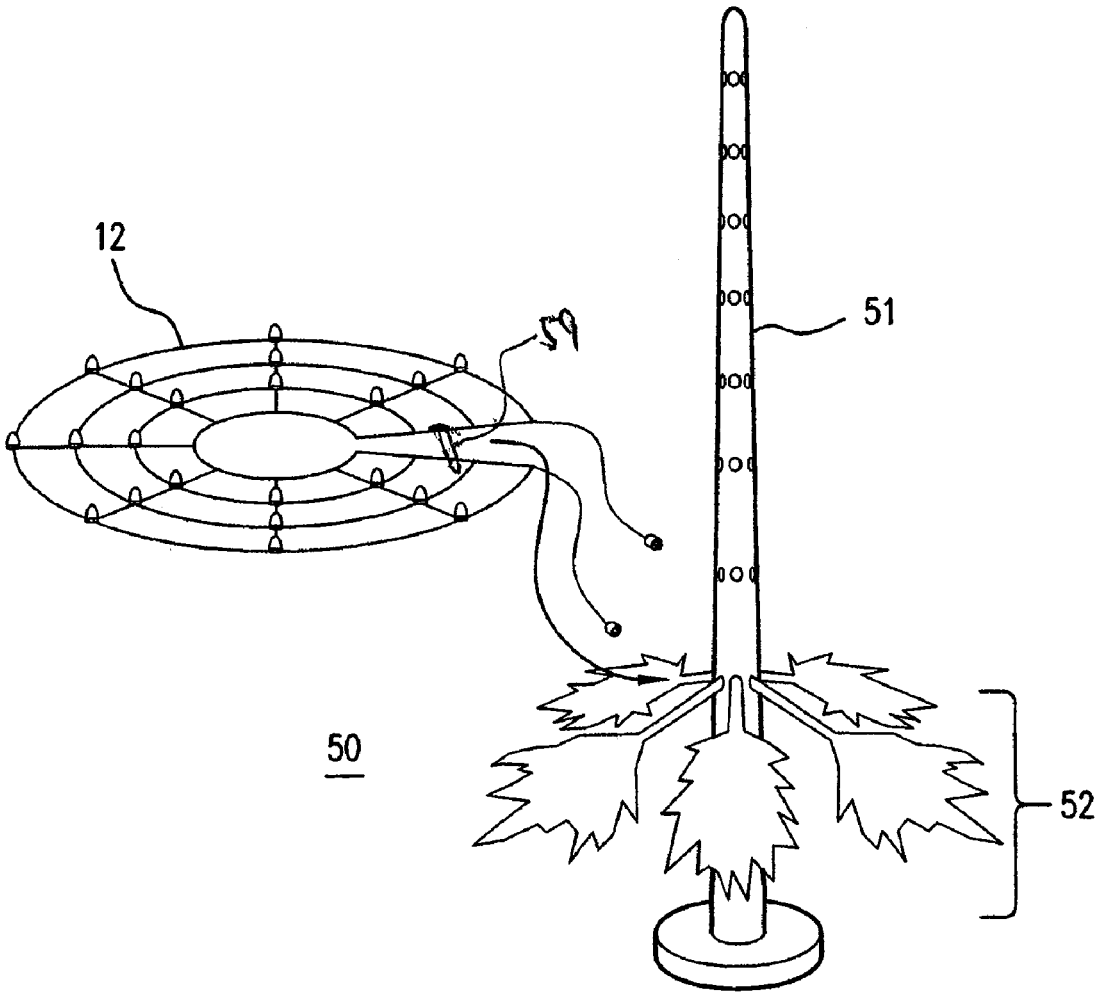
FIGS. 3*a-e* is a series of side views of an artificial Christmas tree being assembled with the lighting system of FIG. 1.
Figure 3B:
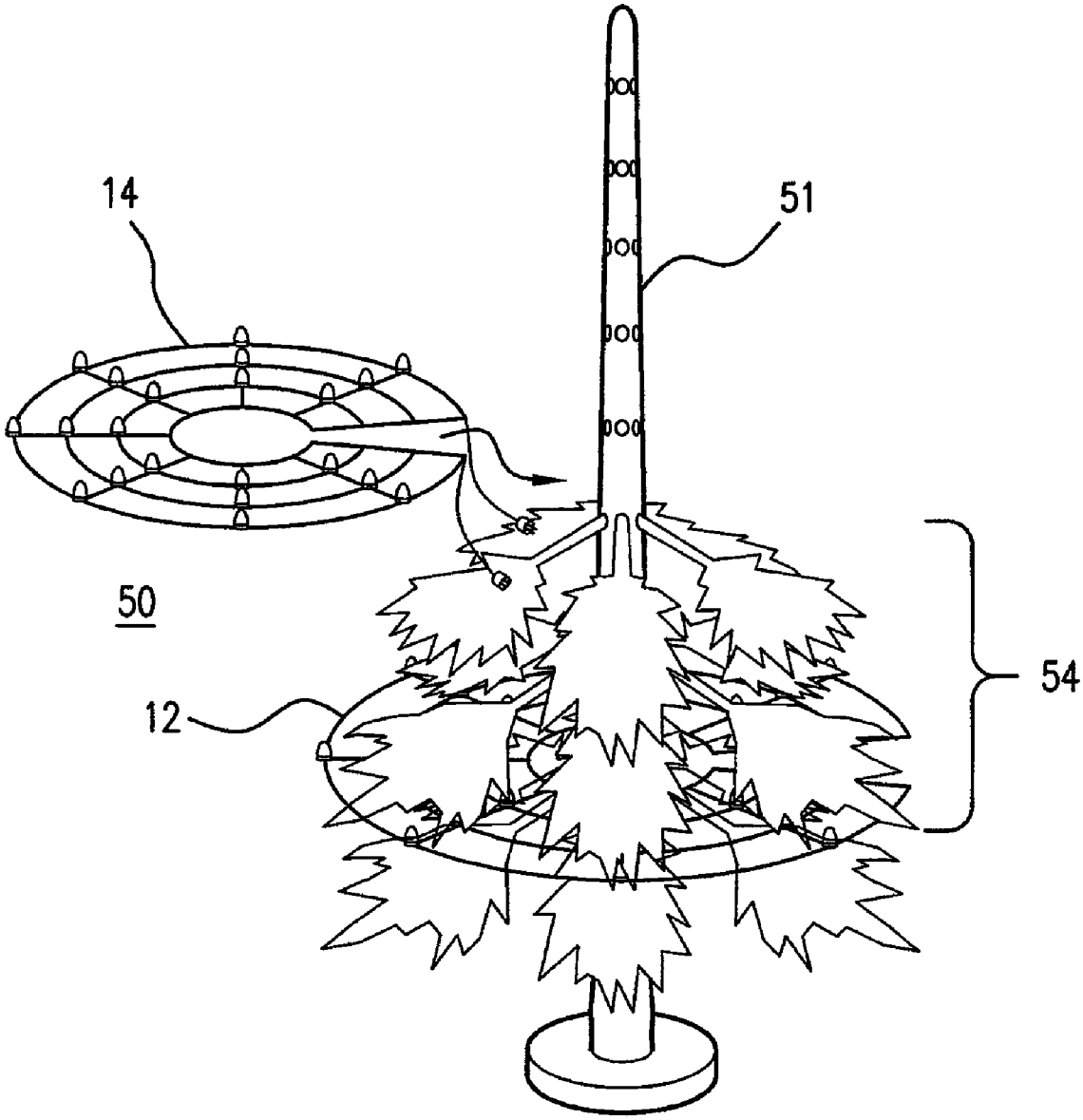
Figure 3C:
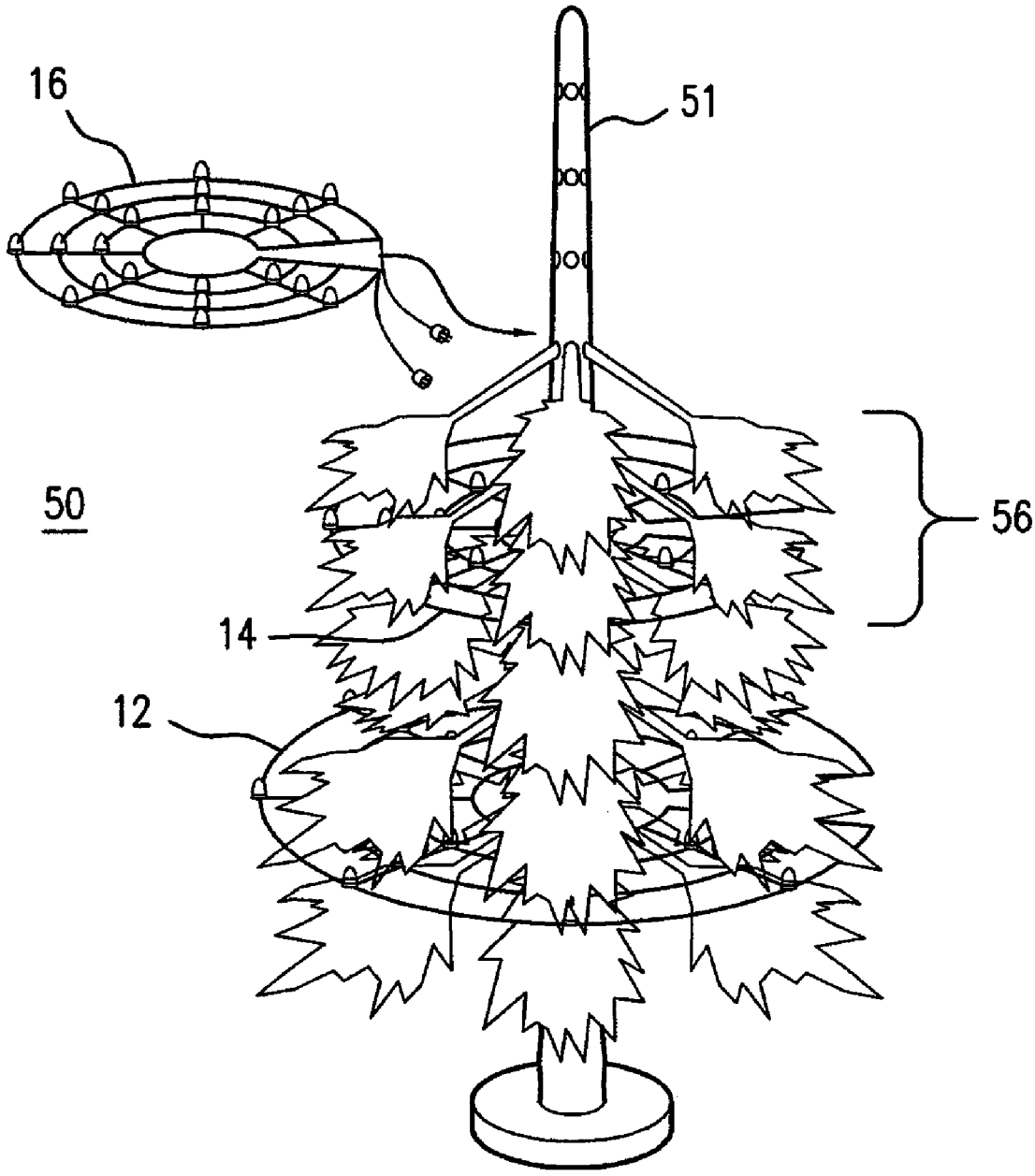
Figure 3D:
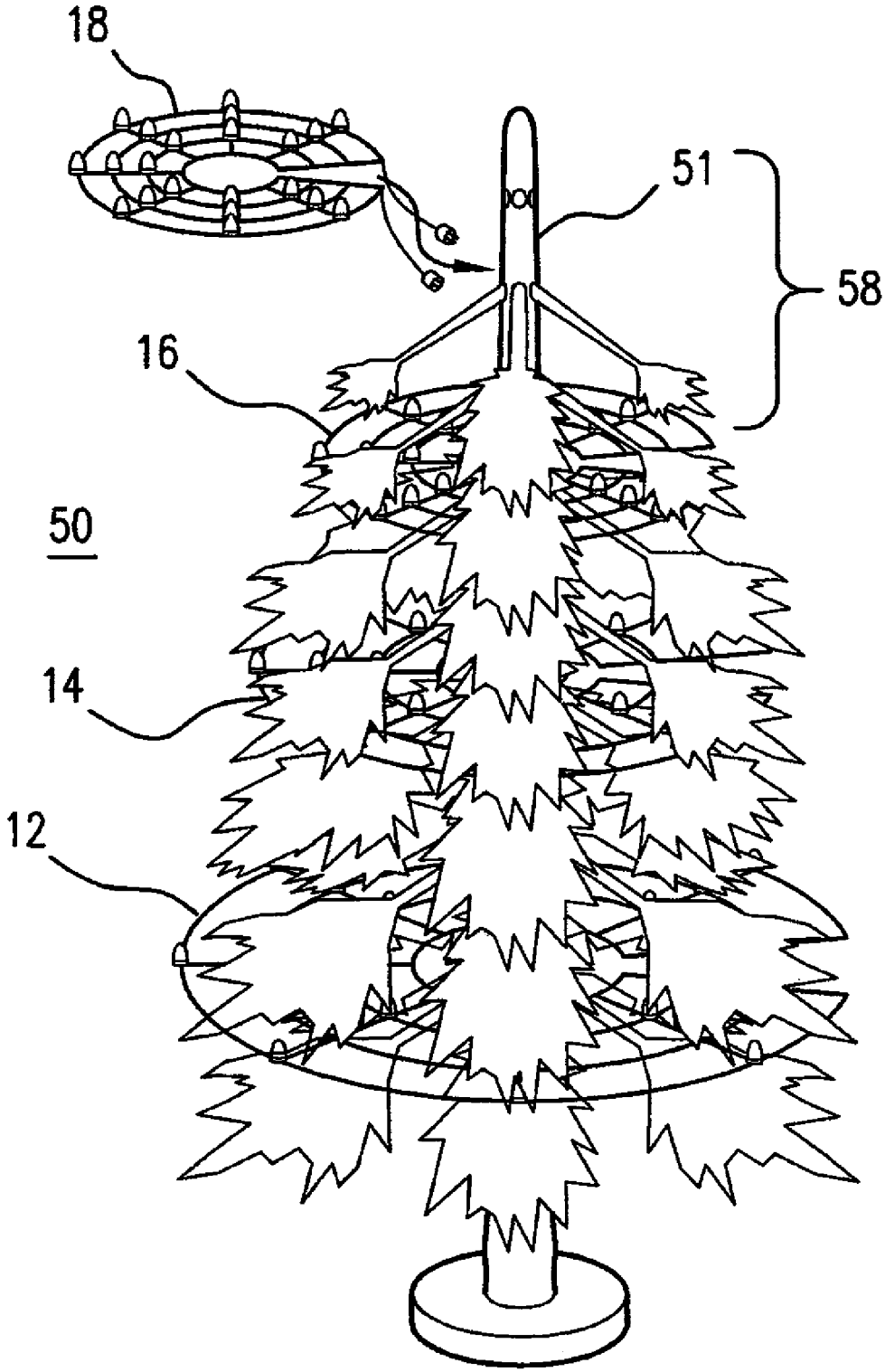
Figure 3E:
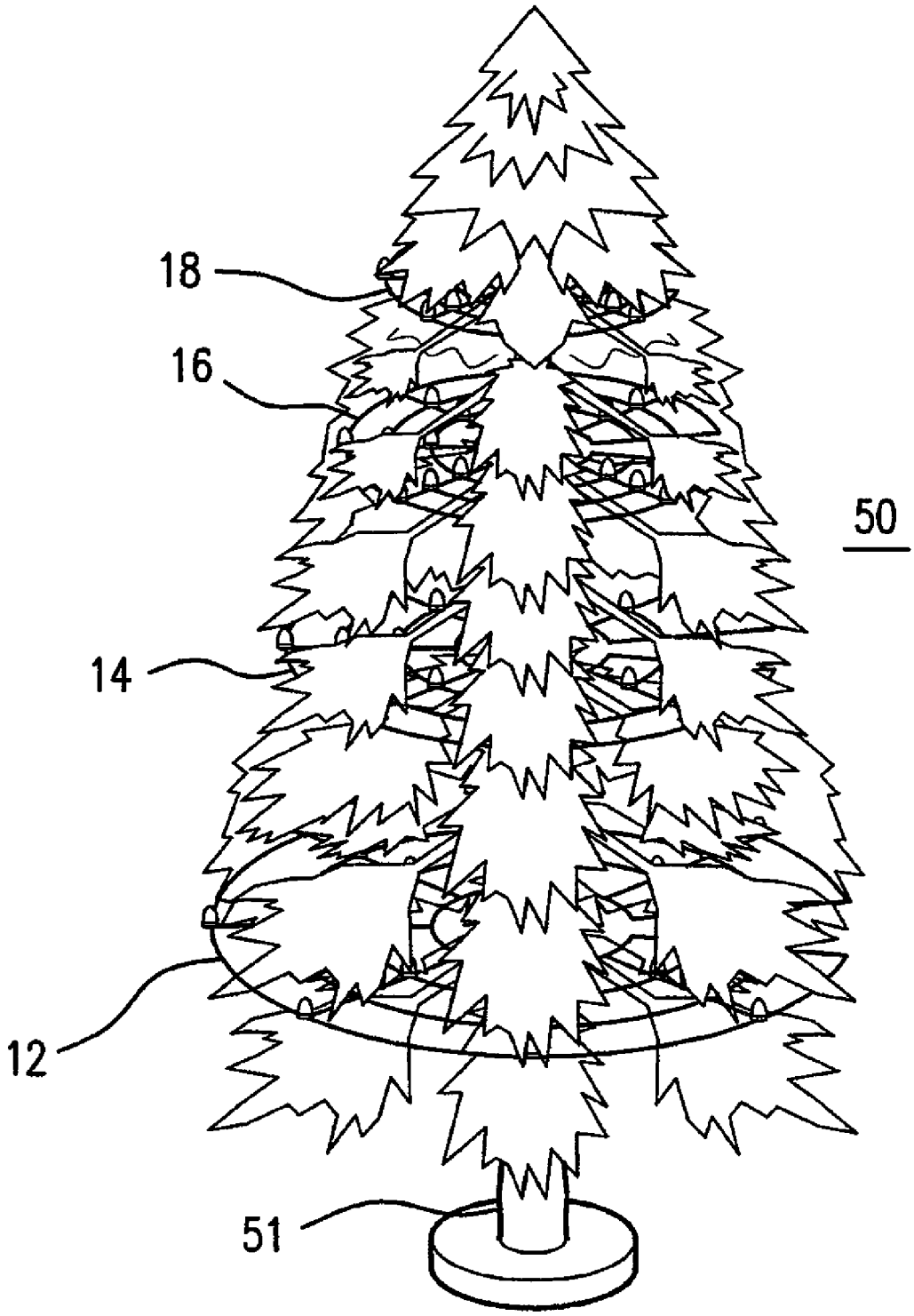

Referring now to FIGS. 3*a-e*, the lighting system 10 of the invention is particularly well-suited for installation on an artificial Christmas tree 50 of the type where individual tiers of branches 52, 54, 56, 58 are inserted in to a central pole 51 starting with the bottom branches and working up. In assembling the artificial tree 50 and the lighting system 10, as illustrated in FIG. 3*a*, an installer first inserts the first tier of branches 52 into the bottom of the central pole 51. After this first step is completed, the installer lays the largest lighting ring 12 onto the top of the first tier of branches 52. As shown in FIG. 3*b*, the installer then inserts the second tier of branches 54 into the central pole 51 and lays the second largest lighting ring 14 onto the top of this tier 54. These steps are repeated for the third and fourth tier of branches 56, 58 and the third and fourth largest lighting rings 16, 18 as shown in FIGS. 3*c* and *d*. The artificial tree 50 with the lighting system installed is shown in FIG. 3*e*. The connector member 59 can be secured at one end as part of the ring assembly or provided separately so the installer can locate it anywhere along the electric wire sides forming or defining the slit. Preferably, the member can be located closer to the aperture to secure the ring around the tree trunk.

It is to be understood that while the invention has been described in conjunction with the detailed description thereof, the foregoing description is intended to illustrate and not limit the scope of the invention, which is defined by the scope of the appended claims. The size, materials, and color, etc. of the components of the lighting system can vary. Other aspects, advantages, and modifications are within the scope of the following claims.

The invention claimed is:

1. A lighting system for illuminating a tree, comprising:

at least one first, flexible planar lighting ring configured to lie in a substantially single horizontal plane relative to a vertical axis of the tree having a largest single linear dimension extending radially from a center to a periphery of said ring, said lighting ring including an arrangement of lights disposed in said substantially single horizontal plane, said lighting ring being defined by a plurality of interconnected coaxial circular rings of electrically conductive webbing carrying said lights, a female electrical connector, and a male electrical connector, individual lights of said arrangement of lights being disposed on each of said coaxial circular rings of electrically conductive webbing;

said flexible lighting ring further having a trunk aperture formed in the center thereof and a slit disposed in said substantially single horizontal plane extending radially from said trunk aperture to said periphery.

2. The lighting system of claim 1, including a plurality of interconnected planar lighting rings arranged in vertically spaced substantially horizontal layers along the vertical axis of the tree, a second lighting ring having a largest single linear dimension that is smaller than the largest single linear dimension of said first lighting ring, said lights being disposed radially on said webbing between said center and said periphery of each of said rings.

3. The lighting system of claim 2, wherein said slit is defined by opposing electric wires of said webbing, said slit being wider at said periphery than at said trunk aperture.

4. The lighting system of claim 2, wherein said slits for each of said lighting rings have a different radial dimension.

5. The lighting system of claim 4, including a flexible connecting strap for releasably securing opposed parts of each of said slits together.

6. The lighting system of claim 1, including a flexible connecting strap for releasably securing opposed parts of said slit together.

7. The lighting system of claim 6, wherein said connecting strap is located closer to said trunk aperture than said periphery.

8. The lighting system of claim 1, wherein said lighting ring has a substantially circular planar shape.

9. A lighting ring for use in a lighting system for illuminating a tree, said ring configured to lie in a substantially single horizontal plane relative to a vertical axis of the tree, the ring comprising:

a net planar web configuration being defined by a plurality of interconnected coaxial circular rings of flexible electrically conductive wiring, an arrangement of lights disposed in said substantially single horizontal plane affixed to said wiring, a female electrical connector and a male electrical connector, individual lights of said arrangement of lights being disposed on each of said coaxial circular rings of electrically conductive wiring, and said lighting ring having a circumference, a trunk aperture located in a center of said ring, and a slit disposed in said substantially single horizontal plane radially extending in said planar web between said trunk aperture and said circumference, said lights being disposed at radial locations in said planar web between said aperture and said circumference.

10. The lighting ring of claim 9, wherein said slit is wider at said circumference than at said trunk aperture.

11. The lighting ring of claim 9, wherein said ring has a circular shape and said slit has substantially conical shape.

12. The lighting ring of claim 11, including a flexible connecting strap secured to said ring for releasably securing opposed parts of said slit together.

13. A method of decorating a tree having a vertical axis with lights, the method comprising a plurality of steps of:

providing a lighting system including at least one first, flexible planar lighting ring configured to lie in a substantially single horizontal plane relative to a vertical axis of the tree having a largest single linear dimension extending radially from a center to a periphery of the ring, the lighting ring including an arrangement of lights disposed in the substantially single horizontal plane, the lighting ring being defined by a plurality of interconnected coaxial circular rings of electrically conductive webbing carrying the lights, a female electrical connector, and a male electrical connector, individual lights of the arrangement of lights being disposed on each of the coaxial circular rings of electrically conductive webbing, the flexible lighting ring further having a trunk aperture formed in the center thereof and a slit disposed in the substantially single horizontal plane extending radially from the trunk aperture to the periphery;

arranging each of the lighting rings in a substantially planar configuration to lie in a substantially single horizontal plane relative to a vertical axis of the tree in vertically spaced relationship along the vertical axis having an arrangement of lights disposed in the substantially single horizontal plane affixed to the electrically conductive webbing radially extending from the vertical axis of the tree to a circumference of each of the lighting rings, and a female electrical connector and a male electrical connector;

electrically interconnecting the rings by connecting the male connector of a first ring to a female connector of a second ring, a trunk aperture positioned in a center of each ring, and a slit being disposed in the substantially single horizontal plane extending between the trunk aperture and the circumference; and placing at least the first lighting ring and the second lighting ring vertically spaced from each other on the tree vertical axis with the trunk aperture at least partially surrounding the vertical axis of the tree.

14. The method of claim 13, wherein the tree is a Christmas tree.

15. The method of claim 13, including a further step of releasably connecting opposed sides of the slit between the trunk aperture and the circumference of the ring.

16. The method of claim 13, including a further step of arranging each of the rings in substantially horizontal orientation relative to the vertical axis of the tree.

* * * * *